United States Patent [19]

Smith et al.

[11] Patent Number: 4,473,445

[45] Date of Patent: Sep. 25, 1984

[54] SELECTIVELY PLATING INTERIOR SURFACES OF LOOSE PIECE ELECTRICAL TERMINALS

[75] Inventors: Mark L. Smith; Richard M. Wagner, both of Harrisburg, Pa.

[73] Assignee: AMP Incorporated, Harrisburg, Pa.

[21] Appl. No.: 564,279

[22] Filed: Dec. 22, 1983

[51] Int. Cl.[3] ..... C25D 5/02; C25D 7/04; C25D 17/00

[52] U.S. Cl. ..... 204/26; 204/224 R; 204/225

[58] Field of Search ..... 204/26, 224 R, 225

[56] References Cited

U.S. PATENT DOCUMENTS

| | | | |
|---|---|---|---|
| 2,448,117 | 8/1948 | Pearson | 204/225 |
| 2,477,808 | 8/1949 | Jones | 204/225 |
| 2,503,863 | 4/1950 | Bart | 204/225 |
| 3,410,781 | 11/1968 | Carlson | 204/225 |
| 3,951,761 | 4/1976 | Bohringer | 204/15 |
| 4,321,124 | 3/1982 | Audelo | 204/224 R |
| 4,340,449 | 7/1982 | Srinivasan | 204/224 R |
| 4,384,926 | 5/1983 | Wagner | 204/225 |
| 4,427,498 | 1/1984 | Wagner | 204/225 |

*Primary Examiner*—Thomas Tufariello
*Attorney, Agent, or Firm*—Katherine A. Nelson

[57] ABSTRACT

An apparatus for continuously plating interior surfaces of loose piece electrical terminals is characterized in that loose piece terminals are continuously fed to a continuously rotating mandrel, are held against the mandrel during the plating process by retaining means and are released from the mandrel, the mandrel having a plurality of anode containing nozzles therein, the anodes being mounted for reciprocation into and out of the interior of the terminals that are against the mandrel. A conduit supplies plating solution under pressure through the nozzles and upon the anodes and into the interiors of the terminals in which the anodes are received. The retaining means is an elongated resiliently mounted member which surrounds a portion of a rotating mandrel whereby the loose pieces are held against the mandrel during the plating process wherein the anodes move into the interiors of the terminals, plating solution is injected over the anodes and the anodes are retracted from the terminals, the terminals being released from the mandrel after the anodes have been retracted and the terminals have passed the end of the retaining means.

10 Claims, 7 Drawing Figures

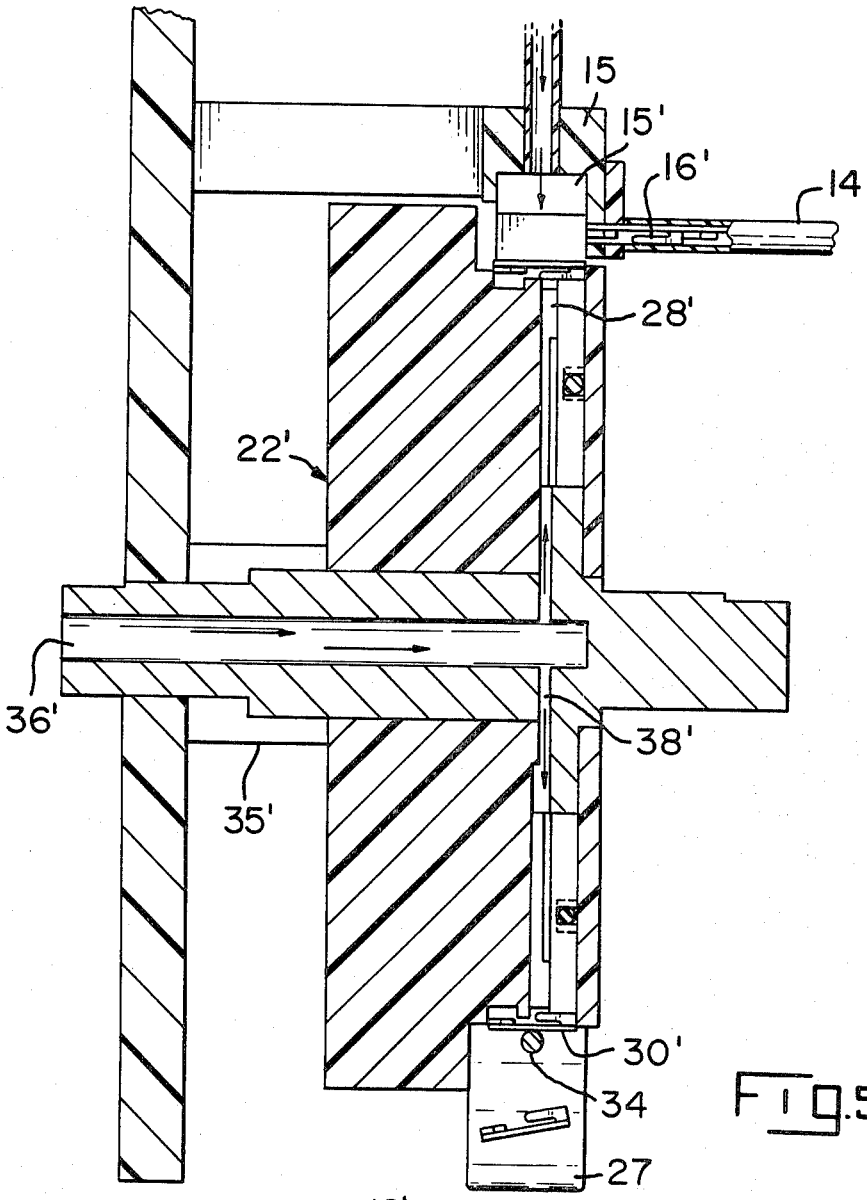
FIG.5
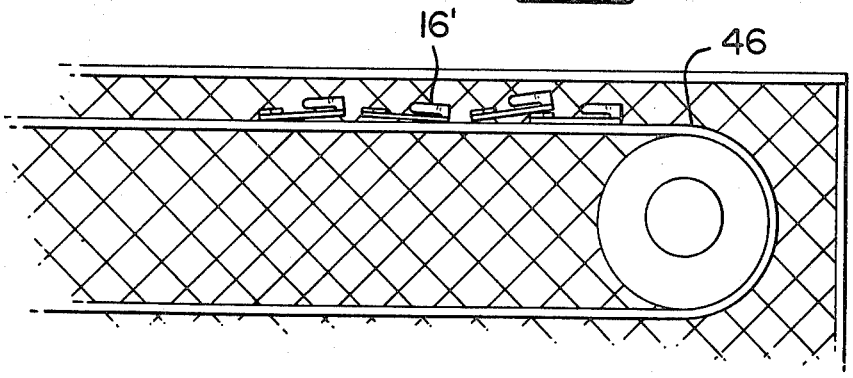

SELECTIVELY PLATING INTERIOR SURFACES OF LOOSE PIECE ELECTRICAL TERMINALS

FIELD OF THE INVENTION

The present invention relates to selective plating; i.e., electroplating selectively on the electrical contact surfaces of electrical terminals to the exclusion of other surfaces of the terminals.

BACKGROUND OF THE INVENTION

The invention relates primarily to the electroplating of the electrical contact surfaces of loose piece terminals with noble metal or noble metal alloys. These metals are characterized by good electrical conductivity and little or no formation of oxides that reduce the conductivity. Therefore, these metals, when applied as plating, will enhance conductivity of the terminals. The high cost of these metals has necessitated precision deposition on the contact surfaces of the terminals, and not on surfaces of the terminals on which plating is unnecessary.

Apparatus for plating is called a plating cell and includes an electrical anode, an electrical cathode comprised of terminals in strip form or loose piece terminals in contact with a separate electrical conducting member, and a plating solution; i.e., an electrolyte of metal ions. The plating solution is fluidic and is placed in contact with the anode and the terminals. The apparatus operates by passing electrical current from the anode, through the plating solution to the terminals. The metal ions deposit, as metal plating on those terminal surfaces in contact with the plating solution.

Heretofore, plating of loose piece terminals was accomplished by immersing all or a portion of the terminals in a plating apparatus such as that disclosed in U.S. Pat. No. 4,321,124. Immersing the terminal in plating solution, however, results in a layer of plating on the outside as well as the inside of the terminal. Masking of loose piece terminals requires at least one more manufacturing operation. Even if the terminals could be masked after they are stamped and formed and prior to their removal from a carrier strip, the process would be time consuming. Some immersed surfaces are difficult to mask, particularly the surfaces of small size electrical terminals.

The present invention accomplishes selective plating according to a rapid automatic process and apparatus without a need for masking immersed terminal surfaces on which plating is unnecessary. The present invention is particularly adapted for plating on the interior surfaces of the loose piece terminals, and not the external surfaces, despite contact of the external surfaces with plating solution.

U.S. Pat. No. 4,384,926, issued May 24, 1983, and U.S. Pat. Application Ser. No. 458,005, now U.S. Pat. No. 4,427,498 owned by this Assignee, disclose plating cells for selectively plating the interior surfaces of electrical terminals that are in strip form. The disclosures in the above mentioned documents are hereby incorporated by reference. The disclosures in the two documents are the subject matter of published European Patent Application No. 83301271.9, published Oct. 12, 1983 under Publication No. 0 091 209.

The present invention discloses a means whereby plating cells such as those disclosed in the above mentioned references can be used for loose piece terminals. The apparatus disclosed herein is comprised of a means for feeding loose piece terminals to a continuously rotating mandrel, a means for retaining the loose piece terminals against a portion of the rotating mandrel, a conduit for supplying plating solution through the mandrel and a source of electrical potential. The mandrel has a plurality of anode containing nozzles therein, the anodes being mounted for reciprocation into and out of the interior of the terminals that are against the mandrel. The conduit supplies plating solution under pressure through the nozzles and upon the anodes and into the interiors of the terminals in which the anodes are received. The electrical current flows from the anodes, through the plating solution and into the interiors of those terminals in which the anodes are received.

The means for retaining the loose pieces against the rotating mandrel is a resiliently mounted member which surrounds a portion of the mandrel as the mandrel rotates, whereby the loose pieces are held against the mandrel during the plating process wherein the anodes move into the interiors of the terminals, plating solution is injected over the anodes and the anodes are retracted from the terminals. The terminals are released from the mandrel after the anodes have been retracted and the terminals have passed the end of the retaining means.

A better understanding of the invention is obtained by way of example from the following description and the accompanying drawings.

DESCRIPTION OF THE DRAWINGS

FIG. 5 is a cross sectional view taken along line 5—5 of FIG. 4.

PREFERRED EMBODIMENT OF THE INVENTION

Figure 1:
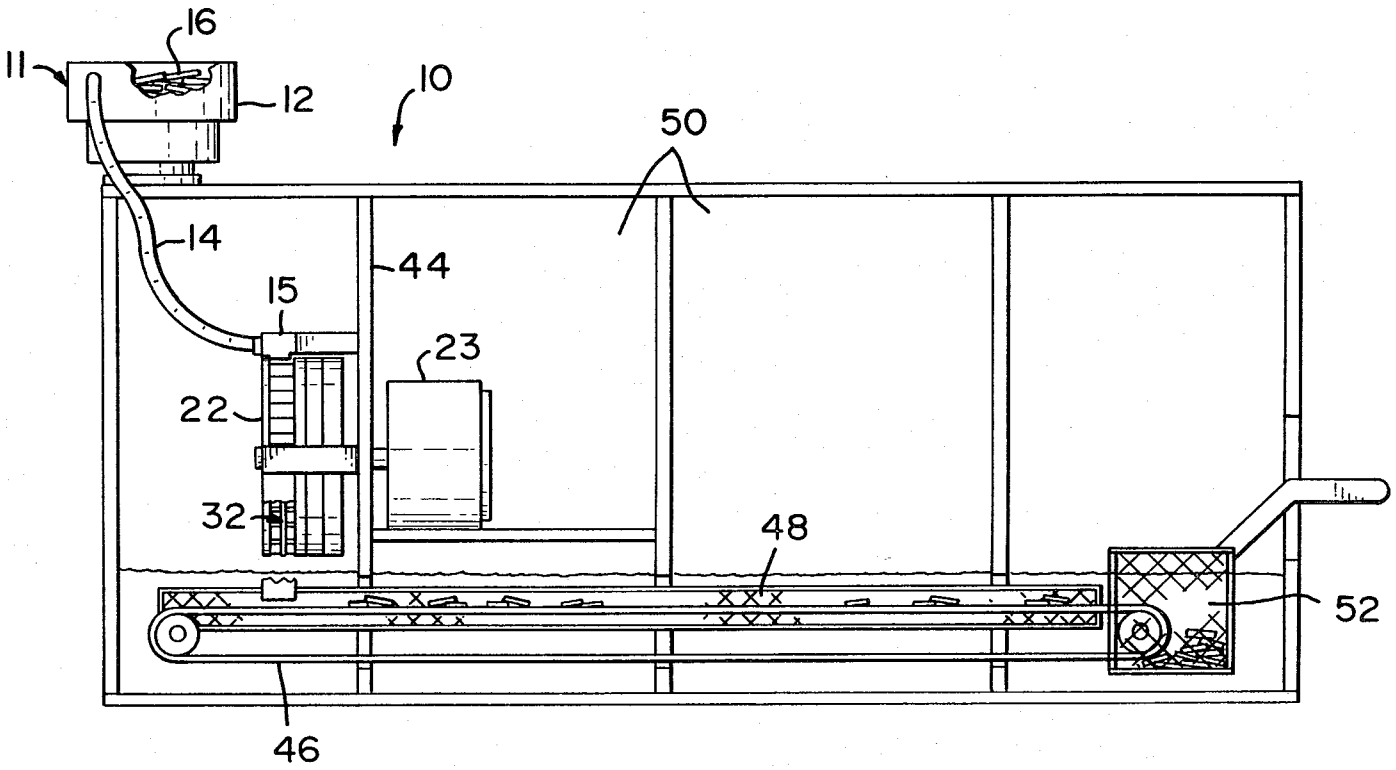
FIG. 1 is a cross sectional view of a plating system which uses the disclosed invention.

FIG. 1 illustrates the use of the loose piece plating apparatus 10 in a typical plating system. In the preferred embodiment, feeding means 11 is comprised of a vibratory bowl 12, a feeding tube 14 and a loading head 15. The feeding means 11 feeds the terminals 16 to a continuously rotating mandrel 22 which is mounted to the wall 44 of the plating tank, the mandrel 22 being driven by the motor 23. During the plating process, the terminals 16 are held against the mandrel 22 by retaining means 32. After the terminals 16 have been plated, they are dropped onto a conveyor belt 46 where they are carried through series of rinse solutions 50 and dropped into collection box 52. This figure further illustrates the use of mesh walls 48 to surround the conveyor belt to prevent the loss of the plated pieces from the moving belt.

Figure 2:
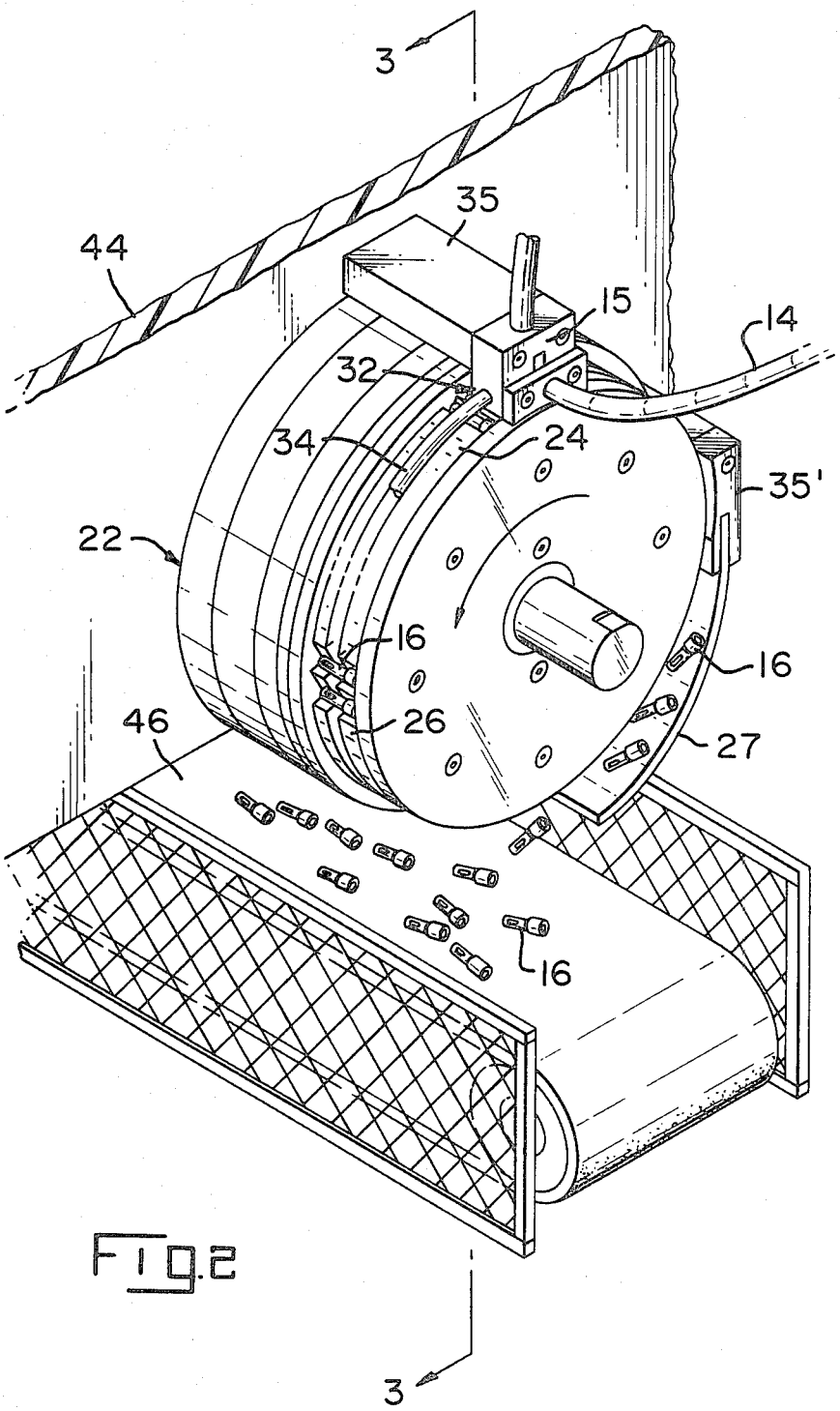
FIG. 2 is a three dimensional view of embodiment of the invention.

Referring now to FIG. 2, retaining means 32 is comprised of a first support member 35, a second support member 35' and an elongated resiliently mounted member 34, the ends of which are held by spaced apart support members 35, 35'. The support members 35, 35' are attached to the wall 44 of the plating tank adjacent the mandrel 22. The elongated member 34 is attached to the support members 35, 35' so that the elongated member 34 wraps around a portion 26 of the mandrel. The first end of the elongated member 34 is proximate the loading head 15 so that the elongated member 34 will retain the terminals 16 against the mandrel 22 as they are loaded into the continuously rotating mandrel 22.

In the preferred embodiment the elongated member 34 is a wire whose tension can be adjusted so that the terminals 16 are held securely against the rotating mandrel 22. In addition to retaining the terminal 16, the wire also conducts electricity to the terminals 16. It is to be understood that materials other than metal can be used as elongated member 34. If such materials are used, a means for conducting electrical current to the terminals would also need to be used.

Figure 3:
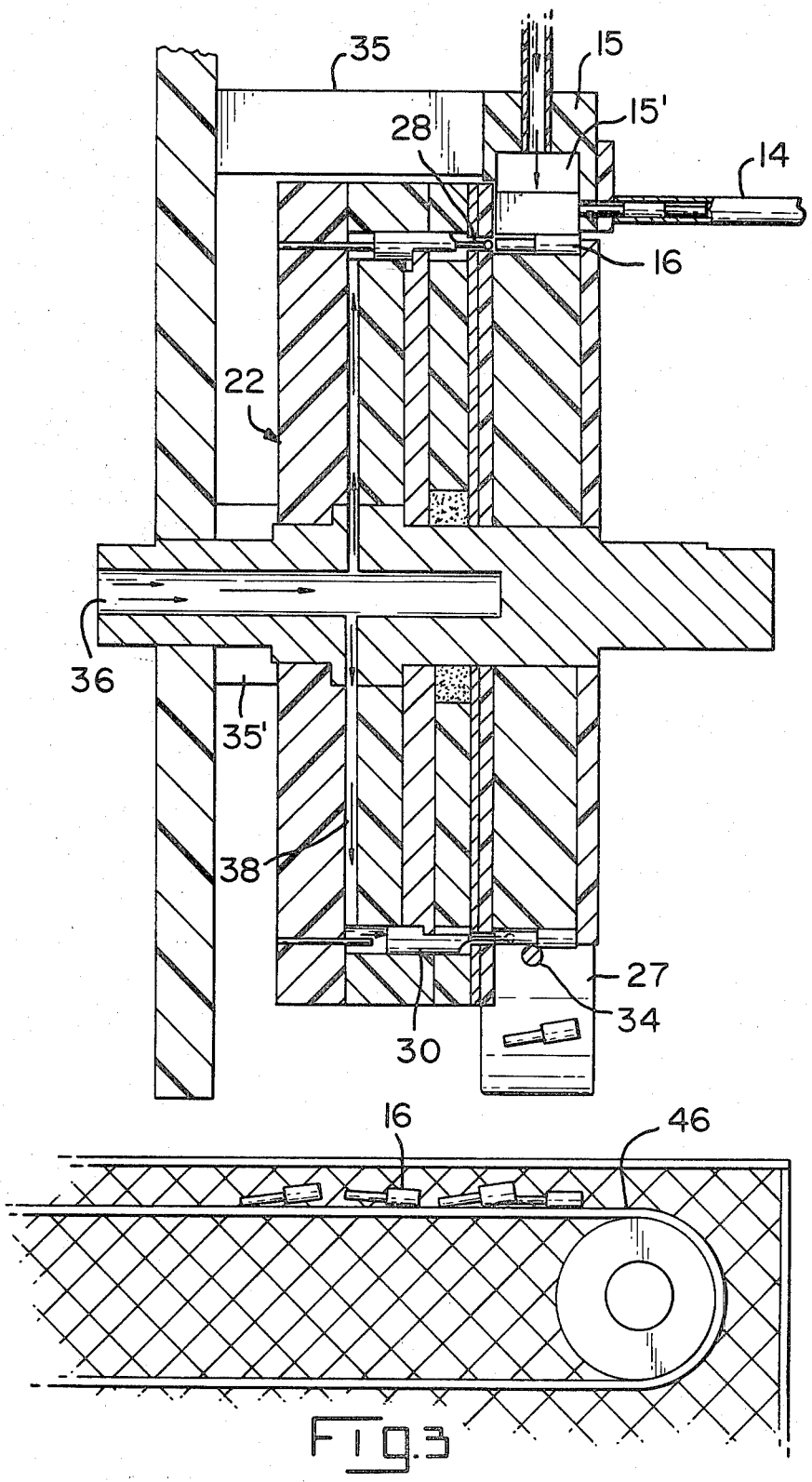
FIG. 3 is a cross sectional view taken along line 3—3 of FIG. 2.

As is illustrated in FIG. 2, mandrel 22 is mounted to rotate in a counterclockwise direction. Elongated member 34 extends in a counterclockwise direction from the first support member 35 to the second support member 35'. The terminals 16 are fed one at a time from feeding tube 14 into the loading head 15. In the preferred embodiment, a loading piston 15' as shown in FIG. 3 moves the loaded terminals 16 from the head 15 onto the aligning surface 24 when the terminal 16 is in proper alignment with a nozzle 28. The terminals 16 are carried by the rotating mandrel 22 under the elongated member 34.

Referring now to FIGS. 2 and 3, mandrel 22 had a plurality of nozzles 28 distributed about the mandrel's axis of rotation. These nozzles contain anodes 30. The anodes 30 are reciprocatably mounted within the nozzles 28 so that the anodes 30 can be moved into and out of the terminals 16 as mandrel 22 rotates. Mandrel 22 is designed to be used with barrel or sleeve type terminals such as the terminal illustrated in FIG. 6 wherein the anode 30 enters one end of the terminal.

As the terminals 16 enter the mandrel 22, they are aligned with nozzles 28. Anodes 30 are moved into the end of the terminals 16 as the mandrel 22 rotates. Plating solution 38 is pumped under pressure through conduit 36 in the mandrel 22 to the nozzles 28 and over the anodes 30 when the anodes are in the terminals 16. Electric current is passed from the anodes 30 through the plating solution 38 to the terminals 16 which are the cathodes. The anodes 30 are retracted from the internal portion 18 of the terminals 16 prior to reaching retaining support member 35'.

As the mandrel 22 rotates, the terminals 16 reach the second support member 35' and the end of the elongated member 34. The terminals 16 are thereby released from the mandrel 22. The terminals 16 drop against a released terminal guide 27 which directs the terminals 16 to the conveyor belt 46.

Figure 4:
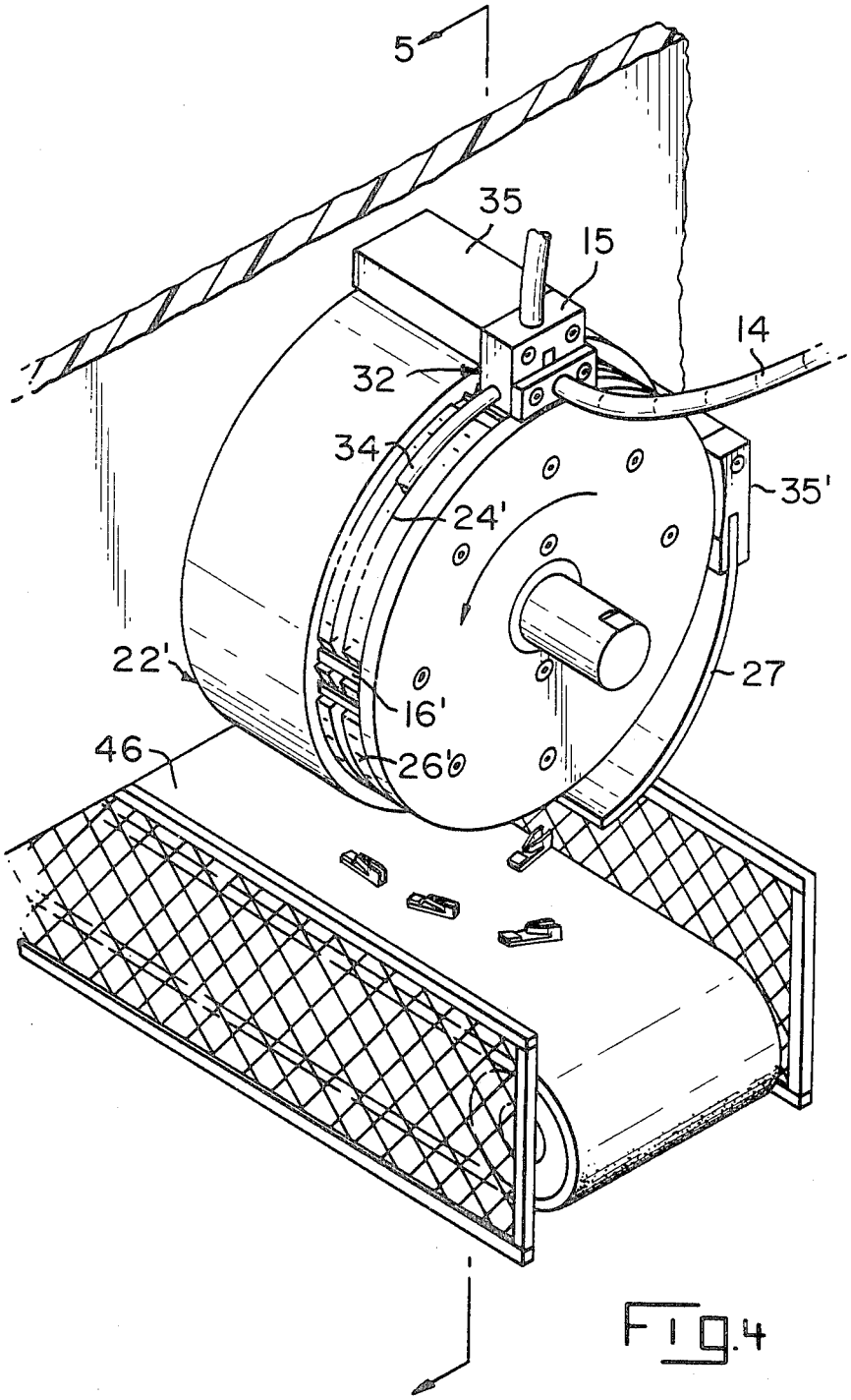
FIG. 4 is a three dimensional view of an alternative embodiment of the invention.

FIGS. 4 and 5 are a three dimensional and cross sectional view of an alternative embodiment of the mandrel 22'. In this embodiment, the mandrel 22' is designed to be used with slot type terminals 16' of the type illustrated in FIG. 7. Terminals 16' are fed to the mandrel 22' through the feeding tube 14 to the loading head 15 where they are aligned with nozzles 28' and are moved against aligning surface 24'.

In this embodiment, the nozzles 28' are distributed about the mandrel's axis of rotation so that the anodes 30' will enter the side of the terminals 16'. As the terminals 16' are carried around the mandrel 22', andoes 30' enter the receptacle 18'. Plating solution 38 is pumped under pressure through conduit 36' through the nozzles 28' and over the anodes 30' to the interior surfaces 20' of the terminals 16'. The anodes 30' are retracted from the terminals 16' prior to the terminals 16' reaching the support member 35'. The released terminals 16' drop onto the guide 27 and thence to the conveyor belt 46.

Figure 6:
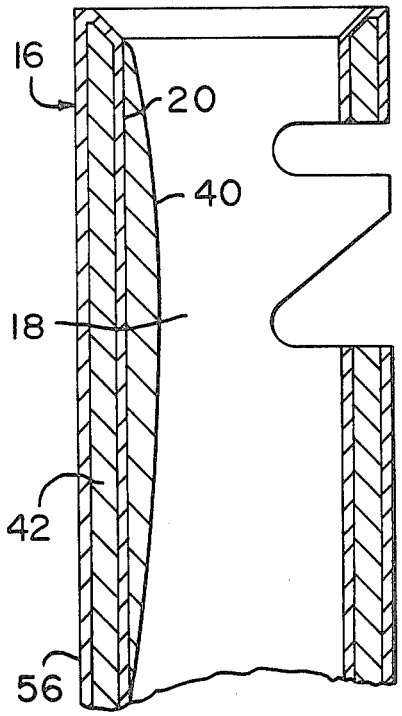
FIG. 6 is an enlarged fragmentary view of a terminal of the type that can be plated with the apparatus of FIG. 3.

FIG. 6 shows the plated surface 40 of a typical barrel or sleeve type terminal 16. The interior surface 20 of the internal receptacle portion 18 of the terminal 16 has a layer of plating 40 thereon.

Figure 7:
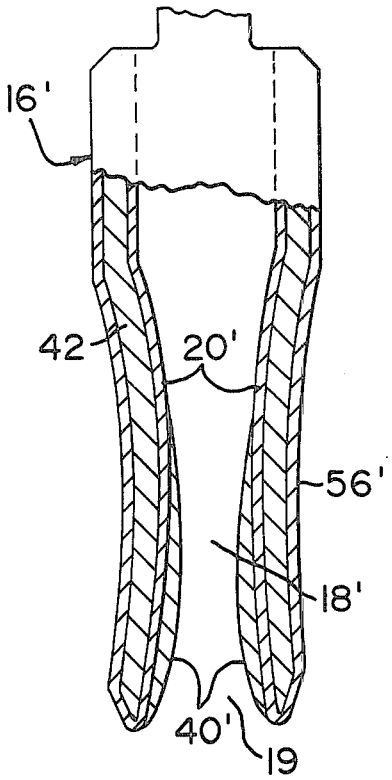
FIG. 7 is an enlarged fragmentary view of a terminal of the type that can be plated with the apparatus of FIG. 5.

FIG. 7 illustrates the plated layer 40' of a typical slot type terminal 16' as plated by the mandrel 22'. The receptacle portion 18' has a slot 19 which has a plated layer 40' on its internal surfaces 20'.

The present invention relates additionally to an electrical terminal that has an interior with a noble metal or noble metal alloy deposit applied by the apparatus described in conjunction with FIGS. 2 and 4 or FIGS. 3 and 5. The deposit has observable characteristics that distinguish from characteristics of plating applied by apparatus and a process other than that described in comjunction with these figures.

A standard requirement of the electrical industry is that an electrical receptacle of base metal, copper or its alloy, should be plated first with nickel or its alloy, then have its interior plated with a precious or semi-precious metal such as cobalt-gold alloy that assures electrical conductivity. Further, the plating must equal or exceed a specified thickness that allows for wear removal of the layer by abrasion. For example, one standard specification requires 15 microinches thickness of cobalt-gold plating extending from the end of the receptacle to a depth of 0.200 inches within the receptacle interior.

The deposit of noble metal or noble metal alloy may also be comprised of successive layers of noble metals such as gold, palladium, silver or their alloys. Successive layers of different noble metals may also be plated on one another, such as an under layer of palladium followed by an over layer of gold.

In the terminals 16 and 16' of the present invention, shown in FIGS. 6 and 7, the terminals are stamped and formed from a base metal 42, 42' of copper or its alloy. A layer of nickel 56, 56' or its alloy is plated over all surfaces of the terminals including the sheared edges produced during the stamping and forming operations. Using the apparatus as described in conjunction with FIGS. 2 and 4 and 3 and 5 respectively, the interior surfaces 20 and 20' of the receptacle portions 18 and 18' respectively, are plated with an outer layer 40 and 40' of noble metal or noble metal alloy, such as gold, platinum, palladium, or silver, or the alloys thereof. An abrupt and steep taper is at the edges of the plating. There is an absence of noble metal or noble metal alloy, of equal or greater thickness, on the exterior surfaces of the terminals.

The even thickness and abrupt tapered edges are characteristics of the plating deposit achieved by selective plating according to the invention. The length of the plating deposit is substantially equal to the length of the anode 30, 30' that extends within the terminal during plating. At the terminal end of the anode 30, 30', the charge and current densities abruptly cease, causing an abrupt tapered edge of the plating deposit. The charge and current densities also cease at the chamfered end of the terminals, causing an abrupt tapered edge of the plating deposit. There is no need for masking the receptacle exterior, and the deposit does not have the non-tapered edge that would result from masking. Further, the plating deposit is substantially free of stress cracks and occlusions, and has a grain structure characteristic of plating deposit.

It is thought that the loose piece plating apparatus of the present invention and many of its attendant advantages will be understood from the foregoing description. The terminals 16, 16' are only exemplary of the many forms of electrical terminals, the internal surfaces of which are capable of being plated by the apparatus of the invention. It will be apparent that various changes may be made in the form, construction and arrangement of the parts thereof without departing from the spirit or scope of the invention or sacrificing all its material advantages. The form herein described is merely a preferred or exemplary embodiment thereof.

What is claimed is:

1. An apparatus for continuously plating interior surfaces of loose piece electrical terminals comprised of means for feeding loose piece terminals to a continuously rotating mandrel, means for retaining the loose pieces against a portion of the rotating mandrel, the mandrel having a plurality of anodes and associated nozzles therein, the anodes being mounted for reciprocation into and out of the interiors of the terminals that are against the mandrel, a conduit for supplying plating solution under pressure through the nozzles and upon the anodes and into the interiors of the terminals in which the anodes are received and a source of electrical potential for supplying electrical current flow from the anodes, through the plating solution and into the interiors of the terminals in which the anodes are received, the apparatus being characterized in that:

the means for retaining the loose pieces against the rotating mandrel is an elongated resiliently mounted member which surrounds a portion of the mandrel as the mandrel rotates, whereby the loose piece terminals are fed to the mandrel, aligned with the nozzles and held against the mandrel during the plating process wherein the anodes move into the interiors of the terminals, plating solution is injected over the anodes and the anodes are retracted from the terminals, the terminals being released from the mandrel after the anodes have been retracted and the terminals have passed the end of the retaining means.

2. The apparatus as recited in claim 1 further characterized in that the resiliently mounted member is metal and provides electrical connection to the terminals during the plating process.

3. The apparatus as recited in claim 1 further charaterized in that the feeding means includes a loading head having a loading piston therein whereby the loading piston moves the terminals onto the mandrel surface as the terminals become aligned with their corresponding nozzles.

4. An electrical terminal having a receptacle portion, the terminal being characterized in that:

the internal surface of the receptacle portion has a deposit of noble metal or an alloy of noble metal plated over the base metal, the interior plated deposit having a thickness in excess of 15 millionths of an inch, edge margins of the interior plated deposit being of tapered thickness and covering at least portions of the sheared edges of the blank which are sheared by stamping, and the external surfaces of the receptacle portion being substantially free of said noble metal plating.

5. The electrical terminal as recited in claim 4, wherein the interior plated deposit is a metal selected from the group consisting of gold, platinum, palladium, silver, their alloys, or successive layers of these metals plated on one another.

6. The electrical terminal as received in claim 4, wherein the interior plated deposit is substantially free of stress cracks and has a grain structure characteristic of a plating deposit.

7. The electrical terminal as recited in claim 5, wherein the base metal is copper or its alloy that is plated over with nickel or its alloy, and the sheared edges of the blank also are plated over with nickel or its alloy.

8. The electrical terminal as recited in claim 6, wherein the base metal is copper or its alloy that is plated over with nickel or its alloy, and the sheared edges of the blank also are plated over with nickel or its alloy.

9. A process for continuously plating interior surfaces of loose piece electrical terminals, the process being characterized by the steps of:

feeding a series of loose piece formed electrical terminals onto an alignment surface of a plating cell fixture, aligning the interiors of the formed terminals with anodes shaped to enter the formed terminals said anodes being mounted for reciprocating movement with respect to the nozzles of the plating cell fixture, providing retaining means to hold the loose piece terminals against a portion of the plating cell fixture, projecting portions of the anodes into the interiors of the formed terminals, jetting streams of plating solution through the nozzles and over the anodes, supplying electrical potential between the terminals and the anodes so that plating is applied to the interior surfaces of the formed terminals that are in proximity of the advanced anodes, retracting the anodes from the interior of the formed terminals and releasing the loose piece formed terminals from the fixture.

10. Loose piece electrical terminals having receptacle portions that have a deposit of noble metal or an alloy of noble metal plated on their internal surfaces, the metal being plated by the process of feeding a series of loose piece formed electrical terminals onto an alignment surface of a plating cell fixture, aligning the interiors of the formed terminals with anodes shaped to enter the formed terminals said anodes being mounted for reciprocating movement with respect to the nozzles of the plating cell fixture, projecting the anodes into the interiors of the formed terminals, jetting streams of plating solution through the nozzles and over the anodes, supplying electrical potential between the terminals and the anodes so that plating is applied to the interior surfaces of the formed terminals that are in proximity to the advanced anodes, retracting the anodes from the interior of the formed terminals and releasing the loose piece formed terminals from the fixture.

* * * * *